US005687278A

United States Patent [19]

Turner

[11] Patent Number: 5,687,278

[45] Date of Patent: Nov. 11, 1997

[54] PORTABLE CLOTHING STEAMER

[75] Inventor: Fredrick C. Turner, Powder Springs, Ga.

[73] Assignee: Frederick C. Turner, Powder Springs, Ga.

[21] Appl. No.: 686,916

[22] Filed: Jul. 26, 1996

[51] Int. Cl.[6] ..... D06F 73/00; H05B 1/00

[52] U.S. Cl. ..... 392/406; 219/211; 223/70

[58] Field of Search ..... 392/404, 405, 392/406; 223/70, 51, 73; 219/211

[56] References Cited

U.S. PATENT DOCUMENTS

| | | | |
|---|---|---|---|
| 1,191,970 | 7/1916 | Hlubucek | 223/70 |
| 1,489,681 | 4/1924 | Wells | 223/51 |
| 1,492,083 | 4/1924 | Pegues | 223/51 |
| 2,045,868 | 6/1936 | Nelson | 223/70 |
| 2,317,924 | 4/1943 | Lendle | 223/70 |
| 2,530,067 | 11/1950 | Maurer | 223/70 |
| 2,562,662 | 7/1951 | Glover, Jr. | 223/70 |
| 2,805,009 | 9/1957 | Jackson | 223/70 |
| 2,969,897 | 1/1961 | Paris | 223/51 |
| 3,752,373 | 8/1973 | Smith | 223/51 |
| 4,728,015 | 3/1988 | Holzapfel et al. | 223/70 |

*Primary Examiner*—Teresa J. Walberg
*Assistant Examiner*—Sam Paik
*Attorney, Agent, or Firm*—Kennedy, Davis & Kennedy

[57] ABSTRACT

A steamer (10) is provided having a tubular upper portion (11), a base (12) and a stanchion (13) extending between the upper portion and the base. The upper portion has a tubular upper bar (18), a tubular middle bar (17) and a lower bar (16), each having a series of steam ports (24) therein. The base has a heating element (28) which heats water within the base to produce steam which is conveyed through the stanchion to the upper portion where it is then expelled through the steam ports. The steamer is configurable between a working configuration and a compact, stowed configuration.

17 Claims, 2 Drawing Sheets

PORTABLE CLOTHING STEAMER

TECHNICAL FIELD

This invention relates to clothing steamers, and especially portable clothing steamers.

Background of the Invention

It has been well known that wrinkles in clothing may be removed with the application of steam. Steam has been applied to clothing for this purpose by a variety of devices. The most common device of recent years has been the steam iron, which uses steam in combination with a heated plate through which the steam is expelled while being manually passed over the clothing. A steam iron however requires an additional rigid support surface, such as an ironing board, beneath the clothing so that the clothing is forcible pressed therebetween. The requirement of an ironing board limits the use of a steam iron for those who are traveling. Additionally, manual ironing is a very time consuming and labor intensive.

Another common type of device employing steam has been the steam press. A steam press typically has two rigid surfaces between which the clothing is sandwiched or pressed. Steam is injected between the two rigid surfaces to complete the pressing process. This type of device however is quite bulky and therefore not easily portable.

Another type of device has been a hand held steamer. A typical hand held steamer has a housing having a water reservoir and heating element therein which produces the steam. The produced steam is expelled from the housing through a series of openings located at the top of the housing. In use, the steamer is manually passed over the clothing with the steamer opening adjacent to or in contact with the cloth. This method of removing wrinkles with a hand held steamer however is again very time consuming and labor intensive.

Thus, there exists a need for an improved device for the efficient steaming of clothing which may be portable for use by travelers for use in a time efficient manner without being labor intensive. Accordingly, it is to the provision of such that the present invention is primarily directed.

SUMMARY OF THE INVENTION

In a preferred form of the invention a portable clothing steamer comprises an inverted V-shaped hanger, means for supporting the hanger above a floor, a manifold having a cross bar with a plurality of steam ports mounted below the hanger, and boiler means for generating and supplying steam to the manifold.

DETAILED DESCRIPTION

Figure 1:
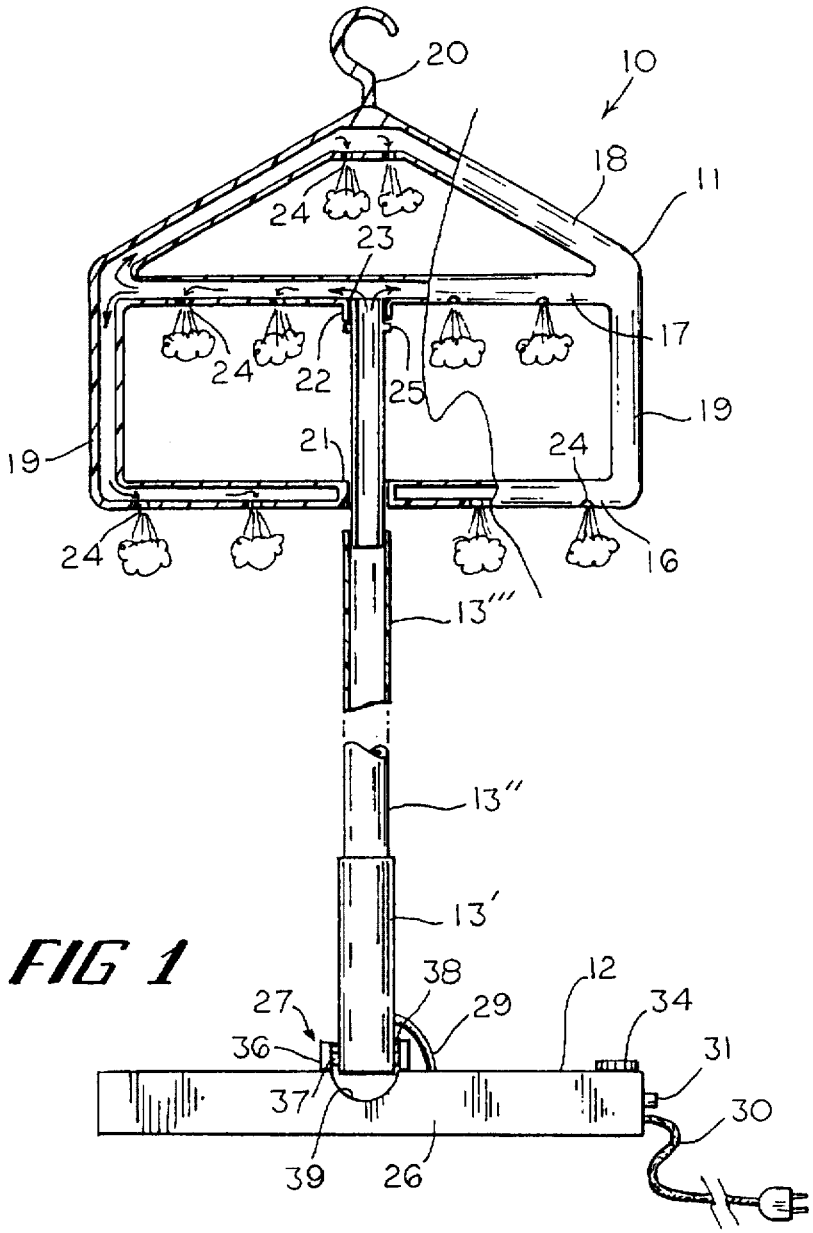
FIG. 1 is a partial cross-sectional, front view of a clothing steamer shown embodying principles of the invention is a preferred form.

With reference next to the drawings, there is shown a clothing steamer 10 having an upper portion 11, a hollow base 12 and an tubular, telescoping stanchion 13 extending between the base 12 and the upper portion 11. The upper portion 11 has a tubular lower cross bar 16, a tubular middle cross bar 17, a tubular, inverted V-shaped upper bar or hanger 18 and two tubular side bars 19 extending between middle bar 17 and lower bar 16. With the upper, middle and lower bars having outlet ports and each being in fluid communication with each other, the upper portion is essentially a manifold for the distribution of fluids. A hanging hook 20 is mounted to the top of the upper bar 18. The lower bar 16 has an annular collar 21 through which extends the stanchion 13. The middle bar 17 has an annular collar 22 about a central opening 23 sized and shaped to receive the top end of the stanchion.

Figure 2:
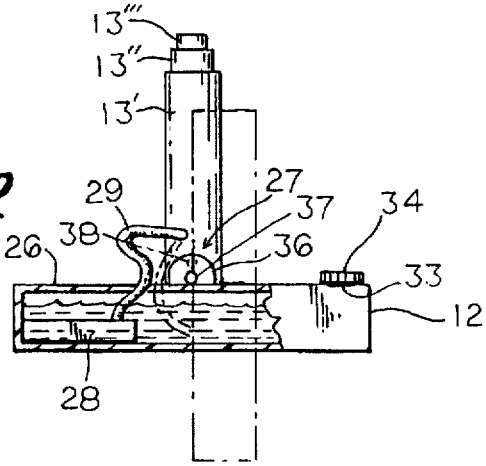
FIG. 2 is a partial cross-sectional, side view of a portion of the clothing steamer of FIG. 1, showing the base in a stationary position and a stowed position.

The stanchion 13 has three tubular sections 13', 13", 13'" which are telescopically and sealably coupled so as to be moved between an extended configuration, shown in FIG. 1, and a compact, retracted configuration, shown in FIG. 2. Stanchion section 13'" also has an annular flange 25 which abuts collar 22 to prevent further inward movement of the stanchion.

The base 12 has a reservoir or outer housing 26 adapted to store a supply of water therein, a hinge 27 rotatably coupled to the bottom of stanchion 13, an electrical heating element 28 of the type typically found in steam irons and steamers positioned within the housing, and a flexible delivery tube 29 extending between the heating element 28 and the interior of the stanchion. As such, it should be understood that the heating element 28 and base 12 act as boiling means to generate as supply of steams from water contained within the base. The heating element 28 has a conventional electric cord 30 and activation switch 31. The housing 26 has a fill opening 33 and a fill cap 34 removably mounted within the fill opening 33. Hinge 27 includes a pair of outer flanges 36 mounted to the top surface of the housing, a pair of pivot pins 37 rotatably mounted to the flanges 36 and coupled to the bottom end of stanchion 13, and detents 38 which releasable hold the positions of the stanchion relative to the base. Hinge 27 allows the base 12 to be rotated about pivot pins 37 between a generally horizontal, operating position and a generally vertical, stowed position, shown in phantom lines in FIG. 2. Base 12 also has a recess 39 configured to receive the stanchion 13 with the base in its stowed position. In use, the steamer 10 is configured for use by placing the base 12 upon a generally level surface, rotating the stanchion 13 to an upright position, and positioning the upper portion 11 upon the stanchion with the top end of the stanchion 13'" extending through the lower bar collar 21 and into the middle bar collar 22. It should be noted that the delivery tube 29 has a length which allows for movement of the stanchion relative to the base. Water is then poured into the base 12 through fill opening 33 and the fill cap 34 replaced within the opening. Clothing to be steamed is then be positioned upon the upper portion 11. For example, a shirt or jacket may be positioned on the upper portion or a pair of pants may be draped over the middle bar 17 in the same manner as one hangs clothing on conventional hangers. Ports 24 are oriented to direct steam between the layers of clothing so as to retain the steam therebetween as long as possible and not to force the steam directly through the clothing. This orientation also directs the steam along the garment, instead of through the garment, for the greatest amount of and most efficient coverage.

With the actuation of switch 31 to its on position the heating element heats a portion of the water therein to a temperature which produces steam. The steam passes through delivery tube 29 into the interior of stanchion 13, where it is then conveyed through the stanchion into the upper portion 11. The steam is conveyed throughout the upper chamber's upper bar 18, middle bar 17, lower bar 16 and side bars 19 so as to be expelled through their respective steam ports 24 and into contact with the clothing draped upon the upper portion. It should be understood that a shirt or jacket draped upon the upper portion is substantially filled with steam from the inside, thus the steam permeates the entire garment to eliminate all wrinkles throughout the garment. Likewise, pants draped over the middle bar 17 is filled with steam emanating from the middle and lower bars while the exterior cloth is permeated by the steam emanating from the upper bar. The garment may then remain upon the steamer until use or the upper portion may be removed from the stanchion and hung by hook 20 upon a door knob or clothes rack. Thus, several upper portions may be used consecutively to process several garments. Alternatively, the garment may be removed from the upper portion and transferred to a conventional hanger.

To stow the steamer, the water may be removed from the base through fill opening 33, the upper portion 11 is removed from the stanchion 13, and the stanchion is collapsed and pivoted to its stowed position nested within the base 12. As such, the entire steamer may be stowed for traveling in a minimal amount of space.

Figure 3:
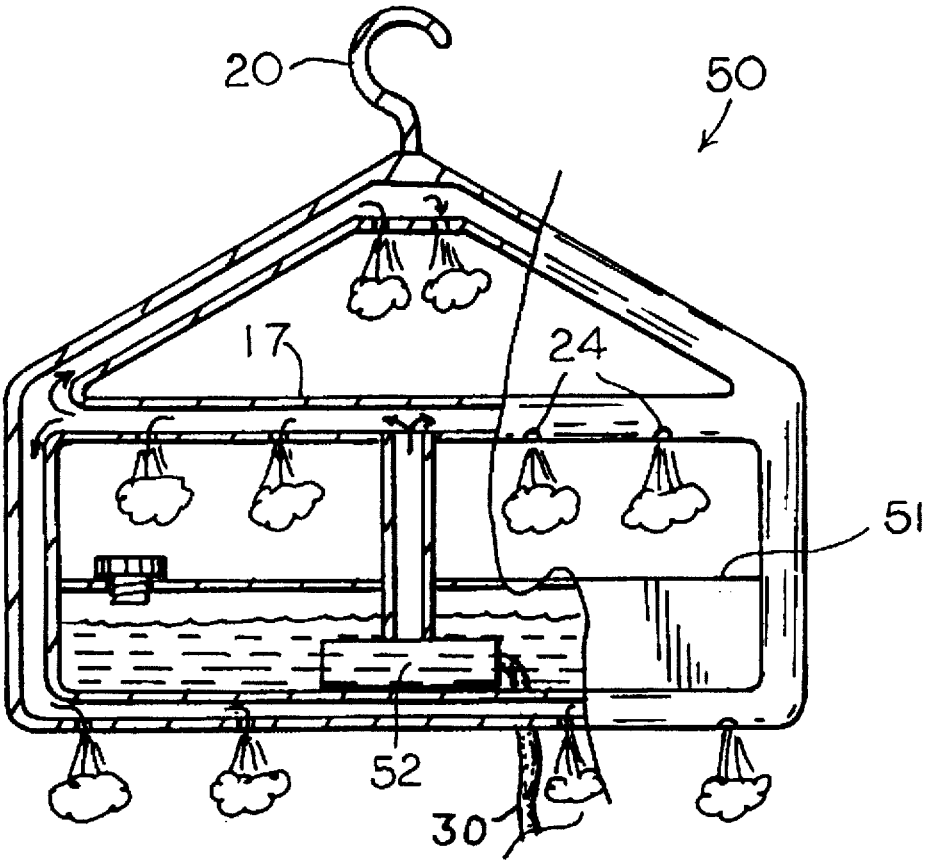
FIG. 3 is cross-sectional, front view of a clothing steamer in an alternative embodiment.

With reference next to FIG. 3, a steamer 50 in another preferred form is shown as an alternative to that shown in FIGS. 1 and 2. Here, the steamer 50 is essentially of the same design as that of FIGS. 1 and 2 except that the base and stanchion have been eliminated and the liquid reservoir 51 and heating element 52 have been incorporated into the upper portion 11 so as to be in fluid communication with the interior thereof.

Steam is produced by heating element 28 and distributed though the upper, middle and lower bars so as to be expelled through steam ports 24. The steamer is supported upon an elevated support structure, such as a doorknob or cloths bar, through hanging hook 20 rather than being self supporting as previously described.

The steamer embodying principles of the invention has either self-supporting means through its base and stanchion as described in reference to FIGS. 1 and 2, or hook supporting means which are used in conjunction with ancillary structure as described in reference to both embodiments.

It thus is seen that a steamer in now provided which may release wrinkles from clothing in an efficient manner without manual operation of a steamer, and which may be easily transported for use in remote locations. While this invention has been described in detail with particular references to the preferred embodiments thereof, it should be understood that many modifications, additions and deletions, in addition to those expressly recited, may be made thereto without departure from the spirit and scope of the invention as set forth in the following claims.

I claim:

1. A portable clothing steamer comprising an inverted V-shaped hanger; means for supporting said hanger above a floor; a manifold having a cross bar with a plurality of steam ports mounted below said hanger; and boiler means for generating and supplying steam to said manifold, and wherein at least a portion of said hanger has a hollow interior in fluid communication with said manifold and at least one steam port.

2. A portable clothing steamer comprising an inverted V-shaped hanger; means for supporting said hanger above a floor; a manifold having a cross bar with a plurality of steam ports mounted below said hanger; and boiler means for generating and supplying steam to said manifold, and wherein said manifold includes a second cross bar mounted below said cross bar having a plurality of steam ports therein.

3. The portable clothing steamer of claim 2 wherein said support means is a hanging hook mounted to said hanger.

4. The portable clothing steamer of claim 2 wherein said support means comprises a base and a stanchion extending from said base to said manifold.

5. The portable clothing steamer of claim 4 wherein said base houses said boiler means.

6. The portable clothing steamer of claim 4 wherein said stanchion is removably mounted to said manifold.

7. The portable clothing steamer of claim 6 wherein said stanchion is pivotably mounted to said base.

8. The portable clothing steamer of claim 4 further comprising support hook mounted to said hanger.

9. A portable clothing steamer comprising a hanger at least a portion of which having a tubular, hollow interior, said hollow interior portion having an inverted V-shaped, tubular upper bar extending to a tubular cross bar coupled to said upper bar, said upper bar and said cross bar having a series of steam ports therethrough; boiler means for generating and supplying steam; support means for supporting said hanger above a floor; conduit means coupled to said boiler means for conveying steam from said boiler means to said hanger interior portion.

10. The portable clothing steamer of claim 9 wherein said hanger hollow portion further comprises a second cross bar positioned between said upper bar and said cross bar, said second cross bar having said steam ports therein.

11. The portable clothing steamer of claim 9 wherein said support means comprises a supporting hook coupled to said upper bar.

12. The portable clothing steamer of claim 9 wherein said support means comprises a base configured to be supported upon a support surface and a tubular stanchion mounted to said base and said hanger hollow portion.

13. The portable clothing steamer of claim 12 wherein said stanchion is telescopic.

14. The portable clothing steamer of claim 12 wherein said stanchion is removably coupled to said hanger.

15. The portable clothing steamer of claim 12 wherein said stanchion is pivotably mounted to said base.

16. The portable clothing steamer of claim 15 wherein said stanchion is removably coupled to said hanger.

17. The portable clothing steamer of claim 12 further comprising a supporting hook mounted to said hanger.

* * * * *